US006684956B1

(12) United States Patent
Berry

(10) Patent No.: US 6,684,956 B1
(45) Date of Patent: Feb. 3, 2004

(54) METHOD AND APPARATUS FOR PRODUCING FLUIDS FROM MULTIPLE FORMATIONS

(75) Inventor: Michael R. Berry, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 27 days.

(21) Appl. No.: 09/956,716

(22) Filed: Sep. 20, 2001

Related U.S. Application Data

(60) Provisional application No. 60/233,951, filed on Sep. 20, 2000.

(51) Int. Cl.[7] ..... E21B 43/00; E21B 43/14; E21B 33/12

(52) U.S. Cl. ..... 166/313; 166/250.01; 166/66.191

(58) Field of Search ..... 166/66, 105, 105.5, 166/106, 191, 250.01, 313

(56) References Cited

U.S. PATENT DOCUMENTS

| | | | | |
|---|---|---|---|---|
| 3,765,483 A | * | 10/1973 | Vencil | 166/313 |
| 5,159,977 A | | 11/1992 | Zabaras | |
| 5,404,943 A | | 4/1995 | Strawn | 166/54.1 |
| 5,881,814 A | | 3/1999 | Mills | 166/313 |
| 6,119,780 A | * | 9/2000 | Christmas | 166/313 |
| 6,135,210 A | | 10/2000 | Rivas | 166/372 |
| 6,250,390 B1 | | 6/2001 | Narvaez et al. | 166/369 |
| 6,325,143 B1 | * | 12/2001 | Scarsdale | 166/106 |
| 6,364,013 B1 | | 4/2002 | Watson et al. | |

OTHER PUBLICATIONS

Yassewr Bangash, Gregory M. Wilson and Max T. Boone, An Encapsulated system designed for severe. CO2 corrosive envrionment in Exxon–Mobil's Postle Field, 38 presented athe 2000 SIE Annual Technical. Conference and Exhibition held in Houston, TX, Apr. 2000.

* cited by examiner

*Primary Examiner*—David Bagnell
*Assistant Examiner*—Brian Halford
(74) *Attorney, Agent, or Firm*—McAfee & Taft

(57) ABSTRACT

An apparatus for producing fluid from a well intersecting a plurality of producing formations. The apparatus includes a pumping system lowered into the well on a production tubing. The well is separated into upper and lower production zones by a packer installed in the well. Fluid is communicated upwardly in the well from the upper zone through a first flow conduit and from the second zone through a second flow conduit. Fluid from both zones is combined and produced upwardly in a single stream. The amount of fluid produced from each zone can be determined with a flow meter which will measure the amount of flow produced from one or more of the zones.

26 Claims, 5 Drawing Sheets

METHOD AND APPARATUS FOR PRODUCING FLUIDS FROM MULTIPLE FORMATIONS

This application claims the benefit of U.S. Provisional Application No. 60/233,951 filed Sep. 20, 2000.

BACKGROUND OF THE INVENTION

The present invention relates to systems for producing fluid from hydrocarbon formations, and more specifically is directed to methods and apparatus for producing fluids from a plurality of producing formations intersected by a well.

It is well known that wellbores drilled for the production of hydrocarbons often pass through two or more producing formations. Fluids from the producing formations typically enter the well through perforations formed in a well casing adjacent the producing formation. Fluids contained in the formation may be raised by pumping systems to another zone or to collection points above the surface of the earth. There are a number of methods that have been developed for producing multiple zone wells. For example, one traditional method of producing a multiple zone well is to isolate the zones using packers or the like, and to produce the well one zone at a time from the bottom of the well upwardly until each zone is exhausted. Producing the well in this manner, however, may cause the well to fluctuate between production peaks and only marginal production as each zone is exhausted. Other methods for producing multiple formations in oil and gas wells are set forth in U.S. Pat. No. 6,250,390 B1 and U.S. Pat. No. 5,881,814. U.S. Pat. No. 5,881,814 discloses an apparatus for producing fluid from two producing zones through a single production tubing with progressive cavity pumps. U.S. Pat. No. 6,250,390 B1 discloses a dual submersible pumping system and permits the pumping of fluid from separate zones without commingling of fluids.

While there are a number of methods and apparatus for producing fluid from a wellbore with multiple producing formations, there is still a need for improved methods and apparatus of doing so. For example, in addition to preventing cross flow between reservoirs, it is sometimes desirable to determine the production from each zone. Thus there is a need for an apparatus that will produce from more than one zone to maximize production from the well, and that will provide for a method to determine the amount of production from each zone whether or not fluids from different zones are produced in the well separately or are commingled and produced upwardly in a single stream.

SUMMARY OF THE INVENTION

The present invention is directed to a method and apparatus for producing fluids from multiple formations intersected by a well. In one embodiment the present invention has a first packer, which is preferably a dual packer, positioned in the well above an uppermost producing formation. A second packer is positioned in the well to divide the well into upper and lower production zones. The first packer has first and second openings therein. Both the upper and lower production zones include at least one and may each have a plurality of producing formations.

A first flow conduit is received in an opening in the first, or upper packer and extends both above and below the dual packer so that fluid from the first production zone may be communicated through the first flow conduit upwardly in the well. The fluid from the first production zone may be discharged into an interior of the well above the first packer. A second flow conduit is received in an opening in the upper packer and extends downwardly therefrom into an opening in the second or lower packer. The second flow conduit will thus communicate fluid from the lower production zone into the well above the first packer. Fluid from the second production zone may be discharged into the interior of the well above the first packer. A pumping system is lowered into the well on a production tubing. The pumping system is located above the first packer and will communicate fluid from both the first and second production zones upwardly in the production tubing. Thus, fluid from the lower production zone and the upper production zone will be combined and produced upwardly in a single stream in the production tubing on which the pumping system is lowered. The pumping system is preferably an electric submersible pumping system and thus includes an electric submersible pump, driven by an electric motor.

Each of the first and second flow conduits preferably has a check valve positioned therein. The check valve will allow for flow upwardly through the flow conduits but will prevent the flow of fluid downward therethrough. A flow meter is connected in one of the first or second flow conduits for measuring the amount of fluid flow from the zone with which the flow meter is operably associated. Preferably, the flow meter is positioned in the first flow conduit above the check valve therein and thus will measure the rate of flow from the first or upper production zone. The amount of fluid produced from each zone can thus be determined, even though fluid from both the upper and lower production zones is delivered to the surface in a single stream. The amount of fluid produced from the first or upper production zone can be determined with the flow meter, and the amount of fluid produced from the lower zone can be determined simply by subtracting the amount of fluid produced from the upper zone from the total amount of output through the production tubing.

The first flow conduit may comprise a tailpipe connected to the lower end of the pumping system and extending downwardly therefrom into the opening in the dual packer. The tailpipe will comprise a perforated tailpipe and thus will have ports therethrough above the flow meter to allow fluid from the upper production zone to be discharged into the interior of the well and then to be passed into the intake for the pump and pumped upwardly in the production tubing. The present invention thus provides a method and apparatus for producing fluids from multiple formations in a well, and for determining the amount of fluid produced from each zone, whether the fluid is produced up the well in a single stream or in separate streams.

DESCRIPTION OF THE EMBODIMENT

Figure 1:
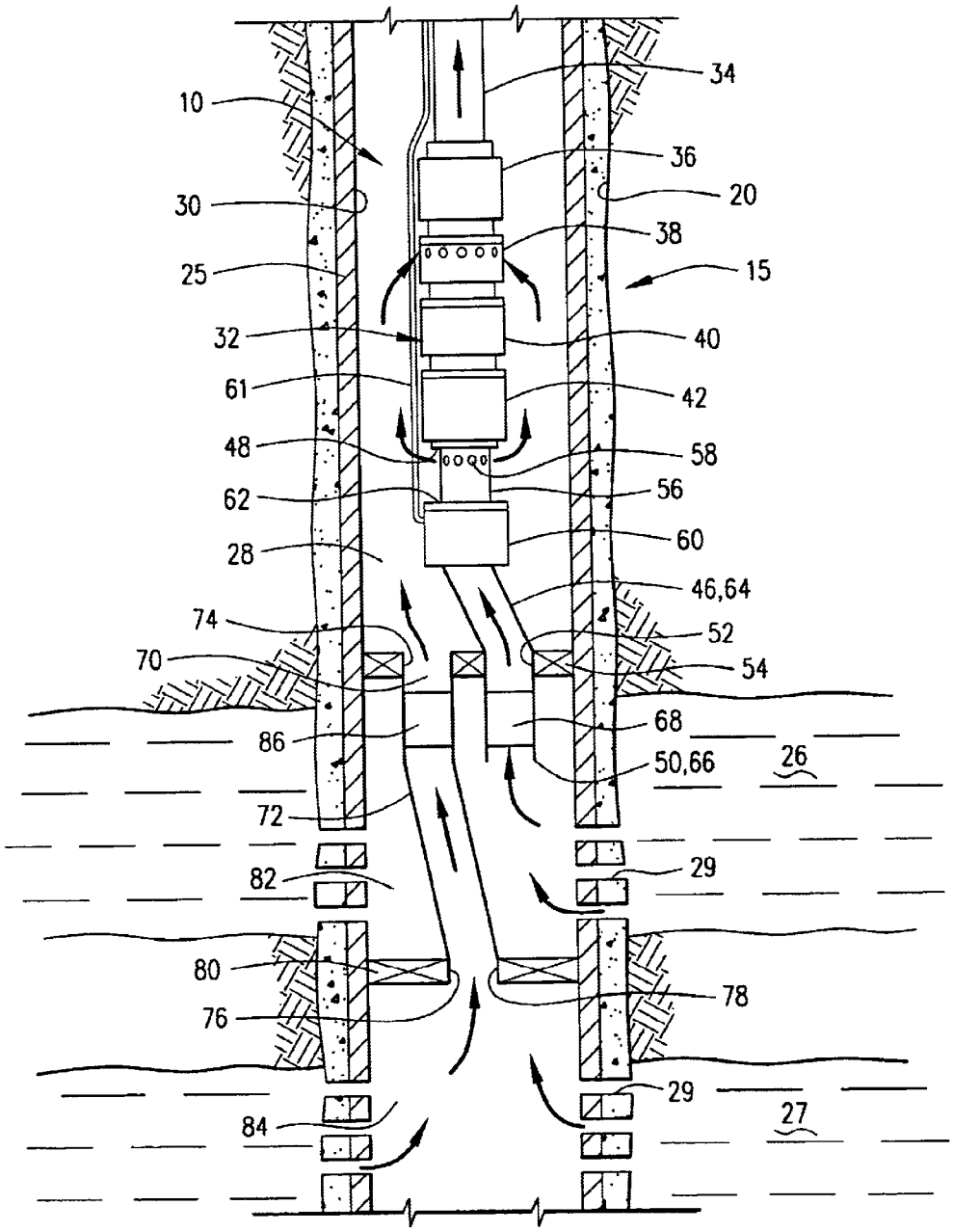
FIG. 1 schematically shows an apparatus for producing fluid from a plurality of production zones.

Referring now to the drawings and more particularly to FIG. 1, an apparatus or system 10 is illustrated according to a preferred embodiment of the present invention. Apparatus 10, which may be referred to as an apparatus for producing fluid from a plurality of production zones, is shown lowered in a well 15 comprising a wellbore 20 having a casing 25 cemented therein. Well 15 intersects a first producing formation 26 and a second producing formation 27. Formations 26 and 27 are communicated with an interior 28 of casing 25, which defines the interior of well 15, with perforations 29. Casing 25 has an inner surface 30 which defines the wall of the well 15. Apparatus 10 includes a pumping system 32 lowered into well 15 on a production tubing 34. Pumping system 32 may be of any type used for delivering fluid from a wellbore, and in the preferred embodiment is an electric submersible pumping system. Pumping system 32 therefore includes an electrical submersible pump 36 connected to production tubing 34 for communicating fluid upward in production tubing 34, for example, to a wellhead. An intake 38 is connected to pump 36 and may be a separate piece, or may be an integral part of pump 36. The intake, as is known in the art has ports through which fluid from the well can be communicated into pump 36. A seal section 40 is connected to intake 38 and is disposed between intake 38 and a motor 42. A power cable 44 is attached to motor 42, and is connected to a power source (not shown) to provide power to motor 42, which drives pump 36.

Apparatus 10 further includes a first fluid flow conduit 46 having an upper end 48 and a lower end 50. Flow conduit 46 extends into an opening or passageway 52 in a dual packer 54 installed in the well above first or upper producing formation 26. Opening 52 may have a flapper valve that is closed until flow conduit 46 is received therein to open the flapper valve.

Dual packer 54 may be referred to as a first, or upper packer. Opening 52 is preferably a seal bore as is known in the art, and flow conduit 46 is received therein. Flow conduit 46 will preferably include a seal assembly to seal in the seal bore. First flow conduit 46 may comprise a perforated tailpipe 56 connected to the base of motor 42 which may be a threaded base. Tailpipe 56 has perforations or ports 58 therethrough. A flow meter 60 which may be a single phase meter, such as for example a venturi, or a turbine type flow meter, or which may be a multiphase or watercut meter, or any other type of flow meter known in the art, may be connected to tailpipe 56 at a lower end 62 thereof. A control line 61 may be connected to flow meter 60 and may extend upwardly to the surface to deliver a signal to a control box from which the amount of flow can be determined. A tubing 64 may be connected to and extend downwardly from flow meter 60 into and preferably through opening 54 to a lower end 66 thereof. A check valve 68 may be disposed in first flow conduit 46. Check valve 68 will allow flow of fluid in the upward direction through flow conduit 46, and will prevent flow downwardly therethrough, and thus may comprise any type of known check or control valve such as for example Wood Group ESP check valve part number 913939.

Dual packer 54 has a second opening or passageway 70 that is connected to a second flow conduit 72 which has an upper end 74 and lower end 76. The connection may be a threaded connection or any other connection known in the art. Conduit 72 is connected at its upper end 74 to packer 54 and extends downwardly therefrom. Lower end 76 is received in an opening or passageway 78 of a second, or lower packer 80. Opening 78 is preferably a seal bore adapted for sealingly receiving the end 76 of second flow conduit 72. Packer 80 is positioned in the well between upper formation 26 and lower formation 27 and thus divides the well into an upper production zone 82, above packer 80, and a lower production zone 84, below packer 80. In the embodiment shown in FIG. 1, upper zone 82 has one producing formation 26 and lower production zone 84 has one producing formation 27. However, upper and lower production zones 82 and 84 will include at least one and may each include a plurality of producing formations. Second flow conduit 72 has check valve 86 therein which like check valve 68 may be any type of check valve known in the art that will allow fluid flow upwardly in flow conduit 72 but will prevent flow therethrough in the downward direction.

The operation of the apparatus may be explained with reference to FIG. 1. Well 15 is separated into upper and lower production zones 82 and 84 with packer 80. Fluid from lower production zone 84, which in the embodiment shown includes fluid from producing formation 27, is communicated upwardly through second flow conduit 72 and check valve 86 and thus passes through, but not into upper production zone 82. Fluid from zone 84 is thus communicated upwardly in well 15, and may be discharged into the interior 28 of well 15 above upper packer 54.

Fluid from upper production zone 82, which in the embodiment shown is fluid from upper producing formation 26, is communicated upwardly in well 15 through flow conduit 46 and thus passes through check valve 68, flow meter 60 and is discharged into the interior 28 of well 15 through ports 58. Fluid from both the upper and lower zones is communicated upwardly through the action of pump 36 which is driven by motor 42. Fluid from both upper and lower production zones 82 and 84 is communicated into intake 38 and is displaced upwardly in production tubing 34 by pumping system 32 so that fluid from zones 82 and 84 is combined and is communicated upwardly in a single stream in production tubing 34. As set forth above, the control line 61 extends from flow meter 60 upwardly to a control unit at the surface where the flow rate of fluid, or amount of fluid produced from upper production zone 82 can be monitored. In this way, it can be determined how much fluid is being produced from upper production zone 82. To determine how much fluid is being produced from lower production zone 84, it is simply required to measure the total fluid output at the surface, and then to subtract the amount of fluid shown to be produced from zone 82 from the total fluid output at the surface to arrive at the amount of fluid produced from zone 84.

The entire apparatus may be installed in well 15 in one operation. However, a more preferable installation is to set lower packer 80 in the well between zones 82 and 84 by any means known in the art. Packer 54 with fluid conduit 72 attached thereto can then be lowered into the well. Flow conduit 72 is inserted into opening 78 and dual packer 54 is set in the wellbore. Pumping system 32, with flow conduit 46 attached thereto, can then be lowered into the well on production tubing 34 and stung into the opening 52 in dual packer 54.

Figure 2:
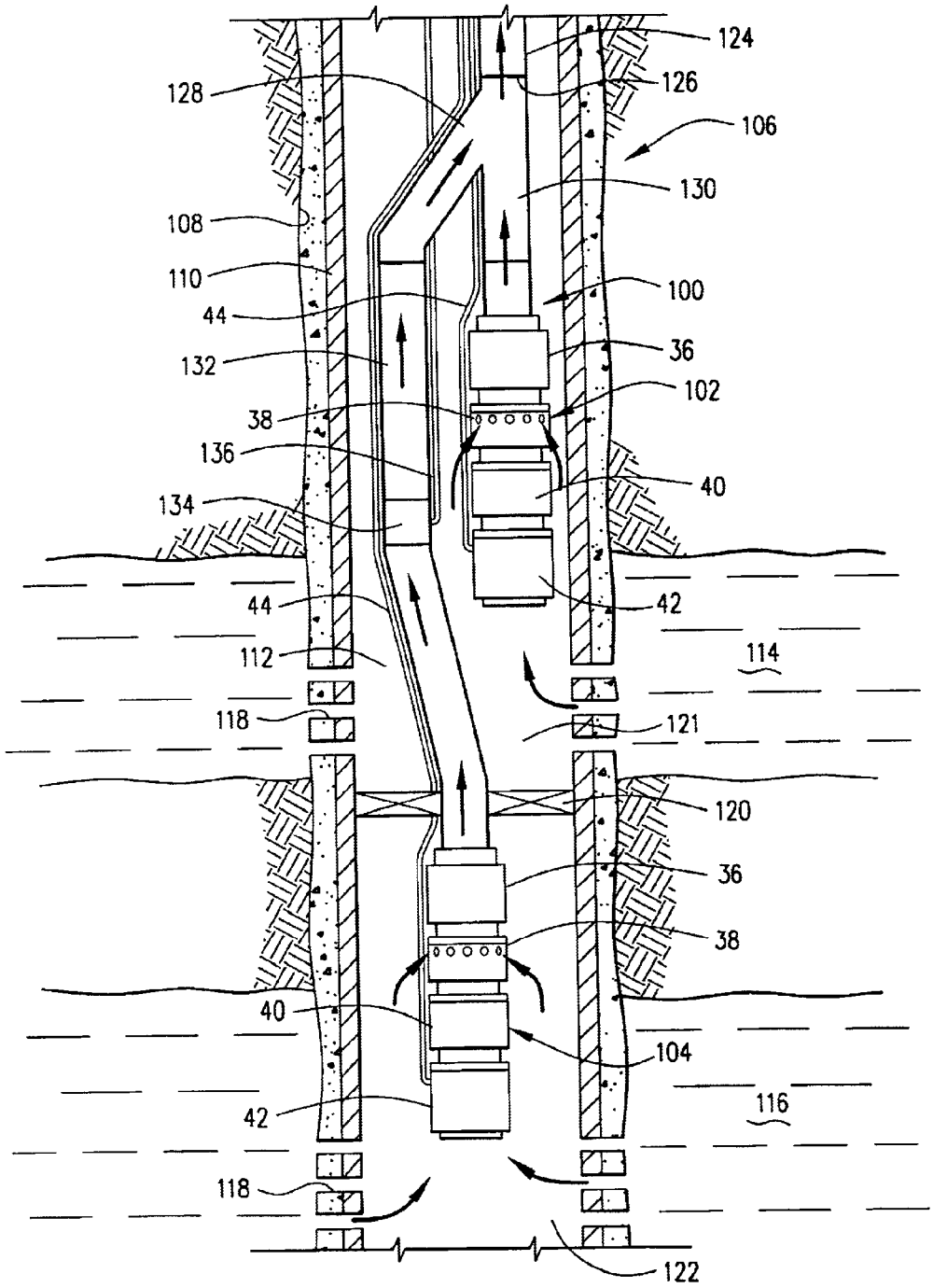
FIG. 2 schematically shows a second embodiment of an apparatus for producing fluids from a plurality of production zones.

An additional embodiment of an apparatus 100 for producing fluid from a well intersecting multiple formations is shown in FIG. 2. Apparatus 100 includes a first pumping system 102 and a second pumping system 104 lowered into a well 106. Well 106 comprises a wellbore 108 having a casing 110 defining a well interior or casing interior 112. Well 106 intersects a first or upper producing formation 114 and a second or lower producing formation 116, each communicated with interior 112 with perforations 118. A packer 120 is positioned in the well between producing formations 114 and 116 and thus divides the well into an upper production zone 121 and a lower production zone 122. Although in the embodiment shown upper and lower production zones 121 and 122 each include one producing formation, the upper and lower production zones will each have at least one and may have a plurality of producing formations. First and second pumping systems 102 and 104 may be like that described with reference to embodiment 1 and thus include a pump 36, an intake 38, a seal section 40 and a motor 42. Each system likewise has a power cable 44 connected to motor 42 that extends upwardly to the surface to a power source (not shown). Packer 120 will thus have a passageway through which power cable 44 on lower pumping system 104 may pass. Pumping systems 102 and 104 are lowered into well 106 on a production tubing 124 having a y-tool 128 at a lower end 126 thereof. Y-tool 128 is connected to a first production branch, or first flow channel or flow conduit 130 connected to pumping system 102 and a second production branch or second flow channel or flow conduit 132 connected to second pumping system 104. Fluid communicated through branches 130 and 132 are combined to form a single stream in production tubing 124.

A flow meter 134 may be disposed in either of first production branches 130 or 132, so that the amount of fluid produced from the zone with which the flow meter is operably associated may be determined. In the embodiment shown, flow meter 134 is shown connected in production branch 132. Thus in the embodiment shown flow meter 134 is operably associated with lower production zone 122 and will measure the rate, or the amount of fluid produced from lower production zone 122. A control line 136 is connected to flow meter 134 and will go to a control unit at the surface wherein the rate or the amount of flow from the zone can be determined.

The operation of system or apparatus 100 is apparent from FIG. 2. Intake 38 on lower system 104 will communicate fluid from lower production zone 122 into pump 36, which will produce fluid from lower production zone 122 upwardly in well 15 through branch 132, and thus through flow meter 134. The fluid from lower production zone 122 is directed from branch 132 through y-tool 128 into production tubing 124. Intake 38 on upper pumping system 102 will communicate fluid from upper zone 120 into pump 36 on system 102, which will pump the fluid upwardly in well 15 through branch 130 into production tubing 124 where it will be mixed with fluid from lower production zone 122. Because the amount of fluid produced from zone 122 may be determined with the use of flow meter 134, the amount of fluid produced from upper production zone 120 may be determined simply by subtracting the amount of fluid produced from zone 122 from the total amount of fluid delivered up production tubing 124. Apparatus 100 is different from apparatus 10, in that with apparatus 10 fluid from the upper and lower production zones is discharged into the interior of the well and then drawn into a production tubing, whereas with apparatus 100, fluid from the upper and lower zones is communicated upwardly through separate flow channels, and the flow channels deliver the fluid from each zone to the single production tubing where the fluid is communicated upwardly.

Figure 3:
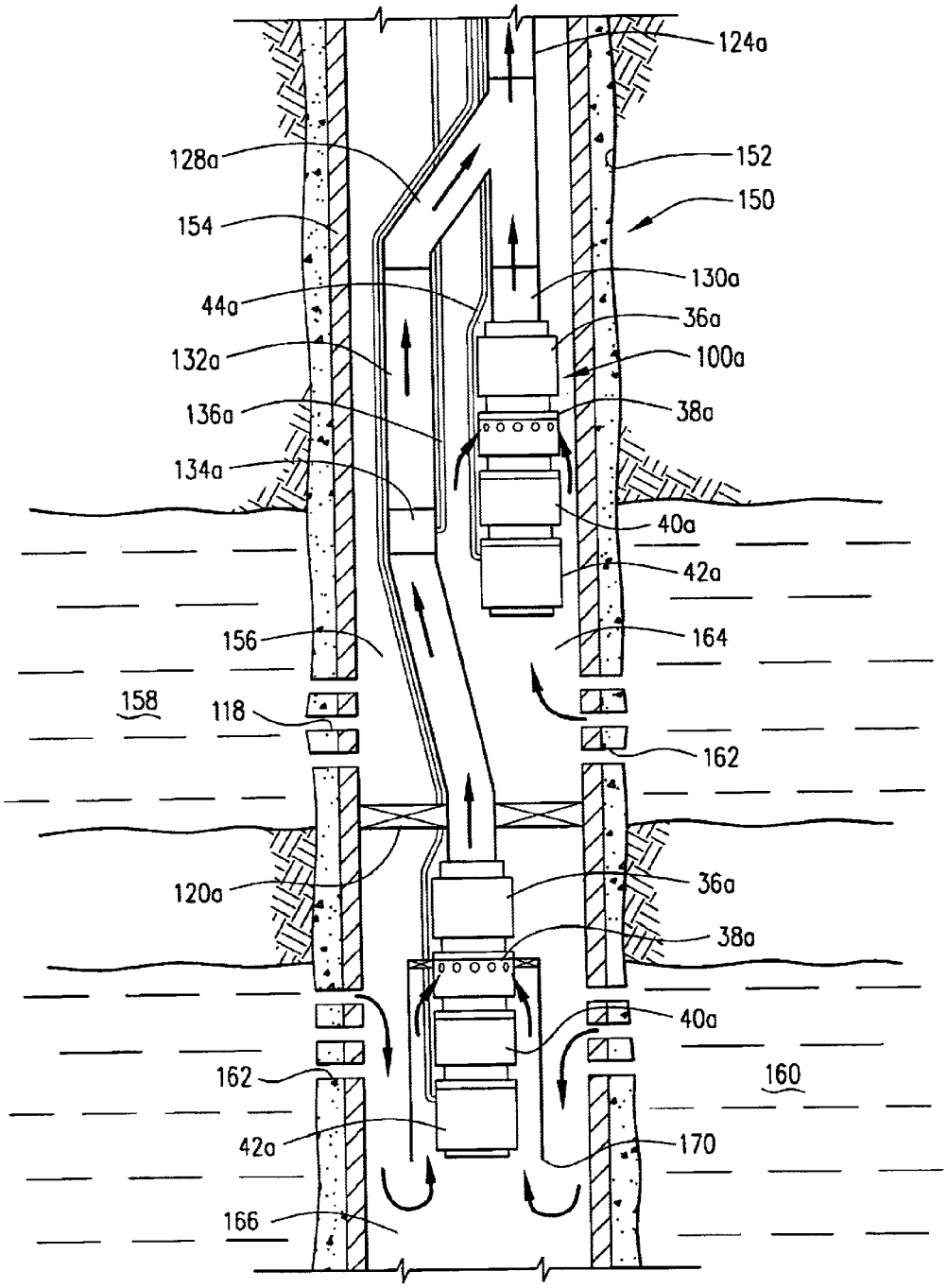
FIG. 3 schematically shows an additional embodiment of an apparatus for producing fluids from a plurality of production zones.

FIG. 3 shows a system 100*a* disposed in a well 150 comprising a wellbore 152 having a casing 154 cemented therein. Casing 154 defines an interior 156 of well 150 and thus an interior of casing 154. Well 150 intersects an upper producing formation 158 and a lower producing formation 160 each communicated with interior 156 through perforations 162. Packer 120 separates upper and lower producing formations 158 and 160 and thus separates the well into an upper production zone 164 and a lower production zone 166. Apparatus 100*a* is essentially identical to apparatus 100 with one primary exception. The components of apparatus 100*a* will thus be designated by the same numerals as set forth with respect to apparatus 100 but will include the subscript a. The distinction between apparatus 100 and 100*a* is that apparatus 100*a* has a shroud 168 disposed about a portion of lower pumping system 104*a*. Because the producing formations in the embodiment shown in FIG. 3 are closer together than those shown in FIG. 2, the pumping system 104*a* cannot be positioned above the producing formation as is pumping system 104 in FIG. 2. When the system in FIG. 2 is operated, fluid from formation 116 will flow past motor 42 prior to entering intake 38 and thus will cool the motor. In the embodiment shown in FIG. 3, the lower formation 160 is above motor 42*a* in system 104*a* and thus, in the absence of shroud 168, fluid therefrom will flow directly into intake 38*a* without passing by motor 42*a*. Shroud 168 is thus connected above intake 38*a* so that when pumping system 104*a* is actuated fluid from formation 160 must flow downwardly around a lower end 170 of shroud 168 and then upwardly past motor 42*a* so that the fluid from formation 160 will cool motor 42*a* prior to entering intake 38*a*. The operation of apparatus 100*a*, other than directing the fluid flow from formation 160 downwardly around the shroud and then upwardly past motor 42*a*, is like that described with respect to apparatus 100 in FIG. 2. Thus, lower pumping system 104*a* will communicate fluid from lower zone 166 upwardly in well 150 past packer 120*a*. Likewise, upper pumping system 102*a* will communicate fluid from upper zone 164 upwardly in well 15 and the fluid from both zones will be combined and communicated upwardly in production tubing 124. Flow meter 134*a* will measure the flow rate or the amount of fluid being produced from lower production zone 166 so that the amount of fluid produced from each zone can be determined as described hereinabove.

Figure 4:
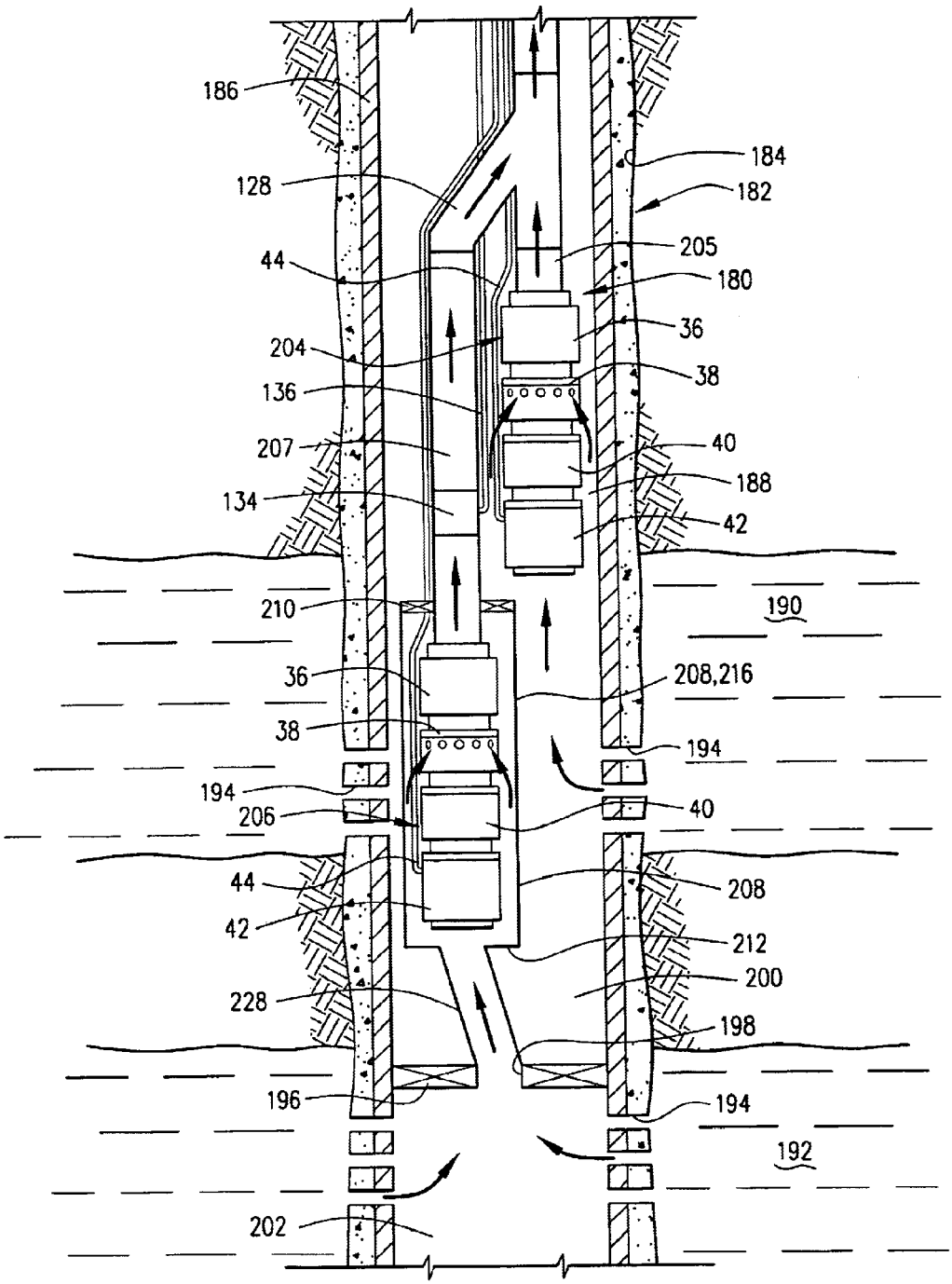
FIG. 4 schematically shows a fourth embodiment of an apparatus for producing fluid from a plurality of production zones.

The final embodiment of the apparatus of the present invention is shown in FIG. 4 and designated by the numeral 180. Apparatus 180 is shown disposed in a well 182 comprising a wellbore 184 having a casing 186 cemented therein. Casing 186 defines an interior 188 of well 182 and thus an interior of the casing 166. Well 182 intersects upper and lower producing formations 190 and 192, that communicate with interior 188 through perforations 194.

A packer 196 having an opening or passageway 198, which is preferably a seal bore, is positioned in the well between upper and lower formations 190 and 192 respectively and thus separates the well into upper and lower production zones 200 and 202. As with the other embodiments, upper and lower production zones 200 and 202 include at least one and may include a plurality of producing formations. Apparatus 180 includes an upper pumping system 204 which comprises an electrical submersible pump 36, an intake 38, a seal 40 and a motor 42 as previously described. A power cable 44 is connected to motor 42 which drives pump 36. Apparatus 182 likewise includes a second or lower pumping system 206 which comprises an encapsulated pumping system 206.

Apparatus 180 is lowered into well 182 on a production tubing 124 with a y-tool 128 as described hereinabove. A first production branch or flow conduit 205 is connected to y-tool 128 and first pumping system 204. A second production branch 207 is connected to y-tool 128 and second pumping system 206. Flow meter 134 may be disposed in either of the first or second production branches, and in the embodiment shown, is in second production branch 207.

Figure 5:
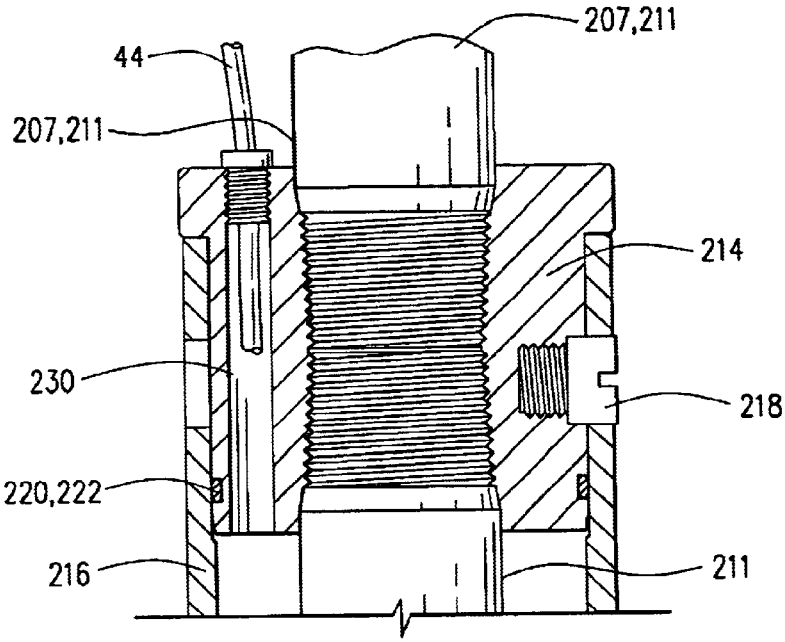
FIG. 5 shows the upper end of the shroud of the embodiment of FIG. 4.
Figure 6:
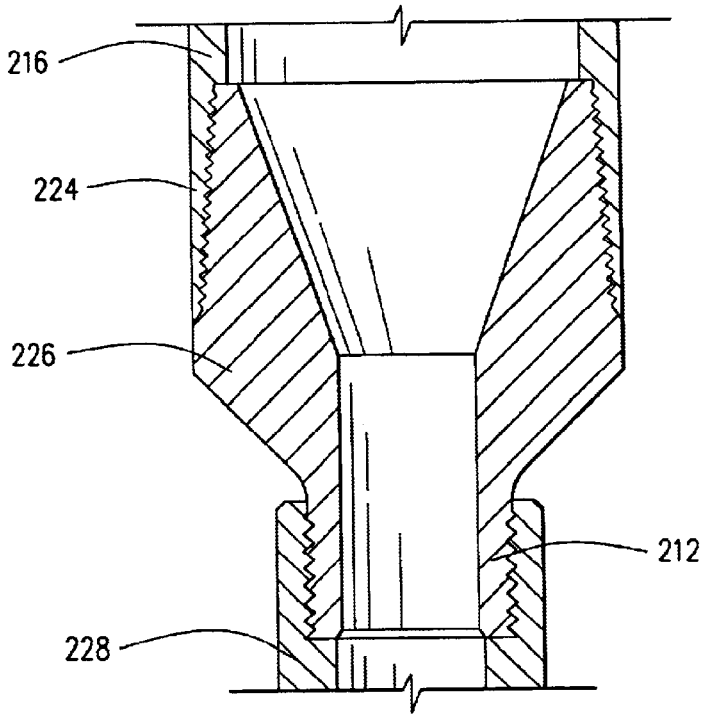
FIG. 6 shows the lower end of the shroud of the embodiment of FIG. 4.

Encapsulated pumping system 206 includes a pump 36, intake 38, seal section 40 and motor 42. A sealed shroud 208 is disposed about pumping system 206, and defines an annulus 209 therebetween. Sealed shroud 208 has an upper end 210 and a lower end 212. Shroud 208 is sealingly disposed about pumping system 206 and thus, as shown in FIG. 5, upper end 210 may comprise a threaded collar or shroud hanger 214 which may threadedly connect pipe joints 211, which may be utilized to make up second production branch 207. A shroud housing 216 may be connected to and extend downwardly from collar 214. Shroud housing 216 may be connected to collar 214 with a fastener 218, or by any other means known in the art. Collar 214 has an o-ring 220 disposed in a groove 222 for sealingly engaging shroud housing 216. Shroud housing 216 extends downwardly to encapsulate pumping system 206, and has an end 224 connected to a threaded adapter 226. Threaded adapter 226 is at lower end 212 of shroud 208, and is adapted to be connected to a tailpipe 228 which can be sealingly inserted into opening 198 in packer 196. Power cable 44 may extend through a feedthrough 230 in collar 214.

Apparatus 180 is lowered into the well on a production tubing 124 with y-tool 128 as with the other apparatus described herein. In the embodiment shown in FIG. 4, however, both of the pumping systems 204 and 206 are positioned above the packer in the well. Pumping system 204 communicates fluid from lower zone 202 upwardly in the well when the pump is actuated by pulling fluid from zone 202 upwardly through tailpipe 228 and into shroud 208 past motor 42. Fluid from zone 202 then enters intake 38 of the lower pumping system 206 from annulus 209 and is communicated upwardly in the well through second production branch 207 which has flow meter 134 therein. Fluid from upper production zone 200 is drawn into intake 38 of upper system 204 and is communicated with the pump 36 upwardly through first production branch 205. Fluids from the upper and lower zones 200 and 202 respectively are commingled and communicated in a single stream upwardly through production tubing 124. The amount of fluid produced from each zone 200 and 202 can be calculated by utilizing the flow meter 134 in the manner described above. Embodiments 2 through 4 utilize a y-tool so that fluids from the upper and lower production zones are ultimately combined into a single stream and communicated upwardly in the well in a single production tubing. However, if desired and if adequate space is available, each pumping system can be lowered into the well on separate production tubings, so that fluid can be produced upwardly from separate zones to a desired collection point through the separate production tubings.

While the invention may be susceptible to various modifications and alternative forms, specific embodiments have been shown. The drawings have been described in detail herein by way of example only. However, it should be understood that the invention is not intended to be limited to the particular forms disclosed. Rather the invention is to cover all modifications, equivalents, and alternatives falling within the spirit and scope of the invention as defined by the following appended claims.

What is claimed is:

1. An apparatus for producing hydrocarbons from first and second production zones intersected by a well, the apparatus comprising;

a first packer positioned in the well above said first production zone;

a second packer positioned in the well between said first and second production zones, wherein said first packer comprises a dual packer;

a first flow conduit for communicating a first production fluid from said first production zone between said first and second packers into an interior of said well above said first packer;

a second flow conduit extending from said first packer to said second packer for communicating a second production fluid from said second zone below said second packer into said interior of said well above said first packer wherein said first and second production fluids are commingled in said interior of said well above said first packer; and a pumping system lowered into said well on a production tubing, wherein the commingled first and second production fluids are communicated into the production tubing and urged upwardly therein.

2. The apparatus of claim 1, said second packer having an opening therein, said first packer having first and second openings therein, the second flow conduit extending from said opening in said lower packer to one of said first and second openings in said first packer.

3. The apparatus of claim 2, further comprising a check valve disposed in said second flow conduit for allowing upward fluid flow upwardly through said second flow conduit and for preventing downward flow therethrough.

4. The apparatus of claim 1, wherein said first flow conduit is disposed in one of a first and a second opening in said first packer and extends upwardly therefrom into said well above said packer to communicate fluid from said first production zone into said interior of said well above said first packer.

5. The apparatus of claim 4 further comprising:

a flow meter connected in said first flow conduit for measuring the amount of said first production fluid produced from said first production zone, wherein said fluid from said first production zone is discharged into said interior of said well above said flow meter.

6. The apparatus of claim 5, said first flow conduit having a check valve therein for allowing fluid flow upwardly into said interior of said well above said first packer and for preventing flow downwardly through said first flow conduit.

7. The apparatus of claim 6, further comprising a check valve connected in said second flow conduit for allowing flow upwardly therethrough into said interior of said well above said packer and for preventing downward flow through said second flow conduit.

8. The apparatus of claim 1, further comprising:

means for determining the amount of fluid produced from each of said first and second production zones.

9. The apparatus of claim 8, said means for determining comprising a flow meter operably associated with one of said first or second flow conduits for measuring the amount of fluid produced therethrough.

10. The apparatus of claim 1 wherein said pumping system comprises, a submersible pump connected to said production tubing;

an intake for communicating fluid from said well into said pump; and a motor for driving said pump.

11. Apparatus for producing fluid from a plurality of hydrocarbon producing formations intersected by a well, the apparatus comprising:

a packer positioned in said well to separate said plurality of producing formations into upper and lower production zones, the upper and lower production zones each comprising at least one producing formation;

a production tubing lowered into said well, said production tubing splitting into first and second production branches at a lower end thereof;

a first pumping system connected to said first production branch for communicating fluid from said upper production zone into said first production branch; and a second pumping system pump for communicating fluid from said lower production zone into said second production branch, wherein fluid from said first production branch and said second production branch are combined in said production tubing and delivered upwardly therein, the first and second pumping systems comprising:

an electric submersible pump;

a fluid intake for said pump;

a motor connected to said pump; and a seal section disposed between said motor and said pump, wherein a shroud having an upper end and a lower end is disposed about said second pumping system, said upper end of said shroud being positioned above said intake of said second pumping system, said lower end of said shroud being located such that fluid from said lower production zone flows around said lower end of said shroud and upwardly past said motor of said second pumping system prior to reaching said intake of said second pumping system.

12. The apparatus of claim 11, wherein one of said first or second production branches has a flow meter connected therein for measuring a flow of fluid through said one of said first or second production branches.

13. The apparatus of claim 11, wherein said second pumping system is positioned below said packer.

14. The apparatus of claim 11, wherein both of said first and second pumping systems are positioned above said packer.

15. An apparatus for producing hydrocarbons from a well, wherein the well intersects a plurality of producing formations, the apparatus comprising:

a packer positioned in said well for separating said formations into an upper production zone and a lower production zone, the upper and lower production zones each having at least one producing formation;

a first pumping system disposed in said well for pumping fluid from said upper production zone upwardly in said well; and a second pumping system disposed in said well for pumping fluid from said lower production zone upwardly in said well, wherein said first and second pumping systems are positioned in said well above said packer;

wherein said first pumping system is connected to a first production tubing lowered into said well from a wellhead and said second pumping system is connected to a second production tubing lowered into said well from said wellhead.

16. A method of producing fluid from a plurality of producing formations intersected by a well, the method comprising:

(a) separating the plurality of formations into upper and lower production zones with a lower packer, each zone having at least one producing formation;

(b) placing an upper packer in said well above said upper production zone, the upper packer comprising a dual packer;

(c) connecting the upper packer to the lower packer with a fluid flow conduit;

(d) communicating fluid from said lower production zone upwardly through said fluid flow conduit and into the well above the upper packer;

(e) communicating fluid from said upper production zone upwardly in said well past said upper packer;

(f) combining said fluid from said upper production zone and said lower production zones in said well to form a single fluid stream; and (g) communicating said single fluid stream upwardly in said well.

17. The method of claim 16, further comprising:

(h) determining the amount of fluid produced from each of said upper and lower production zones.

18. The method of claim 16, further comprising:

discharging said fluid from said upper production zone into an interior of said well above said packer prior to said combining step.

19. A method of determining the amount of fluid produced from different production zones in a well intersecting a plurality of producing formations, the method comprising:

(a) lowering a single pumping system into said well on a production tubing;

(b) separating the well into upper and lower production zones with a packer, each zone having at least one producing formation;

(c) communicating fluid from said lower production zone upwardly in said well past said packer;

(d) combining said fluid from said upper and lower production zones into a single stream;

(e) communicating said single stream upwardly in said well wherein said single pumping system draws fluid from both of said first and second production zones upwardly in said well and communicates said single stream upwardly in said production tubing; and (f) prior to said combining step, determining the amount of fluid produced from one of said upper and lower production zones.

20. The method of claim 19 further comprising:

communicating fluid from said first production zone upwardly in said well past said packer in a first flow conduit prior to said combining step, wherein step (c) comprises communicating fluid from said second production zone upwardly in a second flow conduit, said determining step comprising placing a flow meter in one of said first or second flow conduits to measure a rate of flow therethrough.

21. The method of claim 20, further comprising discharging the fluid from said first and second flow conduits into an interior of said well above said packer prior to said combining step.

22. Apparatus for producing fluid from a plurality of hydrocarbon producing formations intersected by a well, the apparatus comprising:

a packer positioned in said well to separate said plurality of producing formations into upper and lower production zones, the upper and lower production zones each comprising at least one producing formation;

a production tubing lowered into said well, said production tubing splitting into first and second production branches at a lower end thereof;

a first pumping system connected to said first production branch for communicating fluid from said upper production zone into said first production branch;

a second pumping system pump for communicating fluid from said lower production zone into said second production branch, wherein fluid from said first production branch and said second production branch are combined in said production tubing and delivered upwardly therein, the first and second pumping systems comprising:

an electric submersible pump;

a fluid intake for said pump, wherein both of said first and second pumping systems are positioned above said packer;

a shroud disposed about said second pumping system; and a tailpipe connected to said shroud, said tailpipe being received in an opening in said packer, wherein fluid from said lower production zone passes through said tailpipe into said shroud and is communicated from said shroud by said second pumping system into said second production branch.

23. The apparatus of claim 22, wherein one of said first or second production branches has a flow meter therein for measuring the amount of fluid produced from said lower production zones.

24. An apparatus for producing hydrocarbons from a well, wherein the well intersects a plurality of producing formations, the apparatus comprising:

a packer positioned in said well for separating said formations into an upper production zone and a lower production zone, the upper and lower production zones each having at least one producing formation;

a first pumping system disposed in said well for pumping fluid from said upper production zone upwardly in said well;

a second pumping system disposed in said well for pumping fluid from said lower production zone upwardly in said well, wherein said first and second pumping systems are positioned in said well above said packer;

a shroud disposed about said second pumping system, said second pumping system and said shroud defining an annulus therebetween; and a tailpipe extending downward from said shroud to said packer, wherein fluid from said lower production zone passes through said tailpipe into said annulus, and wherein said second pumping system pumps said fluid in said annulus upwardly in a flow channel connected thereto.

25. The apparatus of claim 24 wherein said fluid communicated from both of said first and second pumping systems is displaced upwardly in a single production tubing.

26. An apparatus for producing hydrocarbons from a well, wherein the well intersects a plurality of producing formations, the apparatus comprising:

a packer positioned in said well for separating said formations into an upper production zone and a lower production zone, the upper and lower production zones each having at least one producing formation;

a first pumping system disposed in said well for pumping fluid from said upper production zone upwardly in said well;

a second pumping system disposed in said well for pumping fluid from said lower production zone upwardly in said well, wherein said first and second pumping systems are positioned in said well above said packer, and wherein flow from both of the first and second pumping systems is displaced upwardly in a single production tubing, the single production tubing having a first production branch connected to said first pumping system and a second production branch connected to said second pumping system so that fluid from both of said first and second production branches is communicated upwardly in said single production tubing.

* * * * *